US005979899A

United States Patent [19]

Wilson

[11] Patent Number: 5,979,899

[45] Date of Patent: Nov. 9, 1999

[54] MULTI-ANGLE STABILIZING SUPPORT SYSTEM FOR CONVENTIONAL FOAM ARCHERY TARGET

[76] Inventor: Mark Wayne Wilson, 9101 Lantern Lite Pkwy., Louisville, Ky. 40220

[21] Appl. No.: 09/013,163

[22] Filed: Jan. 26, 1998

[51] Int. Cl.[6] ..... F41J 3/00

[52] U.S. Cl. ..... 273/407

[58] Field of Search ..... 273/407

[56] References Cited

U.S. PATENT DOCUMENTS

| | | | |
|---|---|---|---|
| 4,029,318 | 6/1977 | Boss | 273/390 |
| 4,054,288 | 10/1977 | Perrine | 273/407 |
| 4,066,261 | 1/1978 | Stewart | 273/403 |
| 4,195,839 | 4/1980 | Rodrigue | 273/403 |
| 4,330,129 | 5/1982 | Meredith | 273/372 |
| 4,433,843 | 2/1984 | Bricco | 273/407 |
| 4,546,984 | 10/1985 | Towle et al. | 273/404 |
| 4,643,434 | 2/1987 | Carlin | 273/408 |
| 4,691,925 | 9/1987 | Scholem | 273/407 |
| 4,695,060 | 9/1987 | Pilgrim | 273/404 |
| 4,813,684 | 3/1989 | Bruno | 273/403 |
| 4,850,596 | 7/1989 | Olund | 273/408 |
| 4,913,389 | 4/1990 | McCracken | 248/156 |
| 4,940,244 | 7/1990 | Batts | 273/403 |
| 5,029,874 | 7/1991 | Lamboy | 273/408 |
| 5,067,683 | 11/1991 | Wager | 248/545 |
| 5,209,492 | 5/1993 | Hamilton | 273/407 |

*Primary Examiner*—William H. Grieb

[57] ABSTRACT

A strong, compact, rugged and inexpensive support system to solidly stabilize a conventional rectangular polyethylene foam archery target. System includes a right support (30) and a left support (20), each manufactured from a single piece of elongated material. Each support includes an upper member (21), a base member (22), a radiused intersection (23) and insertion fingers (24) which are pressed into the target to form the target and supports assembly. The supports system utilizes the target itself for structural rigidity without requiring that the supports (20 and 30) be joined to the ground (or surface upon which the target rests). Additional embodiments include ground anchors (51, 52, 60, 70) for use outdoors and protective bumpers (80) for use indoors. Support system includes means for providing a multiplicity of possible target angles to archer. Supports may be assembled such that they form carrying handles for transportation.

19 Claims, 2 Drawing Sheets

10
20
21
22
23
24
25
30
40
50
51
52
60
70
80

MULTI-ANGLE STABILIZING SUPPORT SYSTEM FOR CONVENTIONAL FOAM ARCHERY TARGET

BACKGROUND

1. Field of Invention

This invention relates to support systems for projectile targets; specifically, to such devices as are used to present and stabilize conventional rectangular polyethylene foam archery targets for use both indoors and outdoors.

2. Discussion of Prior Art

For many years, archers have used targets of various designs to practice and improve their shooting skills. These targets require stabilization in order to present the target to the archer in an optimal position. Various types of supporting devices are known to provide target stabilization. These supporting devices are generally specific to a given target design as can be seen in the U.S. pat. Nos. of 5,209,492 to Hamilton (1993); 4,940,244 to Batts (1990); 4,813,684 to Bruno (1989); 4,546,984 to Towle and Towle (1985).

U.S. pat. No. 5,209,492 to Hamilton (1993) discloses a target shooting stand which is designed for thin targets such as made from paper. The stand is made from PVC pipe and has features for connecting the target to the stand which are suited only for thin targets and cannot be used with typical archery targets.

U.S. pat. No. 4,940,244 to Batts (1990) discloses an archery target supporting device which is used integrally with a target made of compressed cardboard or equivalent material. This support system is used as a framework with which to provide the structure necessary to form the target itself. The Batts supporting device cannot be readily separated from the target for storage or transport. The target is not compact nor does it set up quickly since the supporting device and connecting rods must be disassembled and removed when replacing target material. The Batts supporting device provides only one angle of target presentation to the archer making archery practice from elevated positions difficult. The tightening bolts disclosed by Batts provide an opportunity for damage to arrows from impact with the bolts across the entire top and bottom edges of the target. The supporting device disclosed by Batts can only be used with the target also disclosed by Batts, and will not accommodate a variety of target sizes and shapes.

U.S. pat. No. 4,813,684 to Bruno (1989) discloses a device which is also used to support a target of compressed layers of cardboard. Like the Batts system, it is time consuming to set up and operate. This device also presents significant opportunity for arrow damage. The complexity of the design renders the Bruno device expensive to manufacture.

U.S. pat. No. 4,546,984 to Towle and Towle (1985) discloses archery target supporting devices which are also specifically designed for and integral to the target also disclosed. The Towle and Towle supporting devices are not compact and require substantial effort to disassemble the pivot pins from the target frame. The target frame encloses the entire target, providing opportunity for damage to arrows and to the frame around the entire perimeter of the target. These supporting devices can only be used with the target system disclosed by the Towle and Towle patent. The multiplicity of components and processes required to manufacture the Towle and Towle target support system makes it relatively expensive to fabricate.

U.S. pat. No. 4,913,389 to McCracken (1990) discloses a device into which a target is wedged for support. The device is elevated from the ground and depends solely upon ground spikes for support. The device cannot be used indoors and it is not compact. The device presents significant frontal area which may be impacted by arrows, thereby damaging them.

A very common type of archery target is made of a polyethylene plastic foam or similar material and is rectangular in shape. This type of target is sold by outdoor retailers such as Cabela's® and Redhead®, and in sporting goods departments of such general retailers as Wal-Mart® and K-Mart®. These targets are very popular due to their utility, low cost and portability. Manufacturers of such targets typically supply simple aluminum supports to hold the target in an upright position.

One embodiment of such supports is shown on page 213 of the 1997 Cabela's® Fall '97 Annual Catalog. Items H through L have two supports that are longer and are intended to connect the upper half of the target to the ground. The other two supports are shorter and are used to connect the lower half of the target to the ground. Use of these supports requires one end of each support to be pressed into the target. The other end of each support is pressed into the ground to stabilize the target. A similar embodiment is shown on page 67 of Readhead® 1997 Archery Specialists Catalog. Here, the Arrowstop® targets are shown with one upper support which supports the upper portion of the target by resting on the ground and with the two lower supports inserting into the ground as already described.

The supporting devices for common rectangular polyethylene foam (and similar material) archery targets heretofore known suffer from a number of disadvantages:

(a) They are time consuming and awkward to setup.

(b) Their utility is highly dependent upon soil conditions. Since they must be pushed into the ground, dry or hard soil causes great difficulty in setup, often resulting in damage to the supports. Wet soil will not hold the supports and will allow the target to move or fall down.

(c) They do not stabilize the target well over time. Whether the soil is dry or wet, the target loosens after successive arrow impacts, resulting in frequent resetting of the target. This is both time-consuming and annoying to the archer. Archers often use bales of hay or other bulky items as backstops to support the target instead of the supports provided by the manufacturer.

(d) The size and number of the supports lend themselves to loss and misplacement.

(e) These supports require that the foam target be secured to the ground; a significant hindrance to the use of foam targets at indoor ranges. This also precludes outdoor use on most surfaces other than the ground.

(f) The aluminum material from which they are made is easily damaged upon impact by a projectile such as an arrow.

(g) The upper and lower supports work independently and do not rigidly support the target.

OBJECTS AND ADVANTAGES

Accordingly, several objects and advantages of the present invention disclosed herein are:

(a) to provide supporting devices for conventional polyethylene foam archery targets or similar targets.

(b) to provide supporting devices which will rigidly present and hold an archery target at multiple appropriate angles to the archer;

(c) to provide supporting devices which will hold an archery target stable over an extended period of shooting activity;

(d) to provide supporting devices which will minimize potential damage to arrows;

(e) to provide supporting devices which are safe to use;

(f) to provide supporting devices which are readily transportable;

(g) to provide supporting devices which are compact in size;

(h) to provide supporting devices which disassemble easily;

(i) to provide supporting devices which allow the archer to shoot both indoors and outdoors on a variety of surfaces;

(j) to provide supporting devices which are inexpensive.

(k) to provide supporting devices which will function for many years without need for replacement;

(l) to provide supporting devices which, when combined with an archery target, can be set up for use quickly;

(m) to provide supporting devices which require little or no adjustment during extended use;

(n) to provide supporting devices which do not damage the target they are used with;

(o) to provide supporting devices which can be used with a variety of target sizes and types;

(p) to provide supporting devices which are not easily lost or misplaced.

DRAWING FIGURES

In the drawings, closely related figures have the same number but different alphabetic suffixes.

REFERENCE NUMERALS IN DRAWING

Figures 1, 2, 3, 4A, 4B:
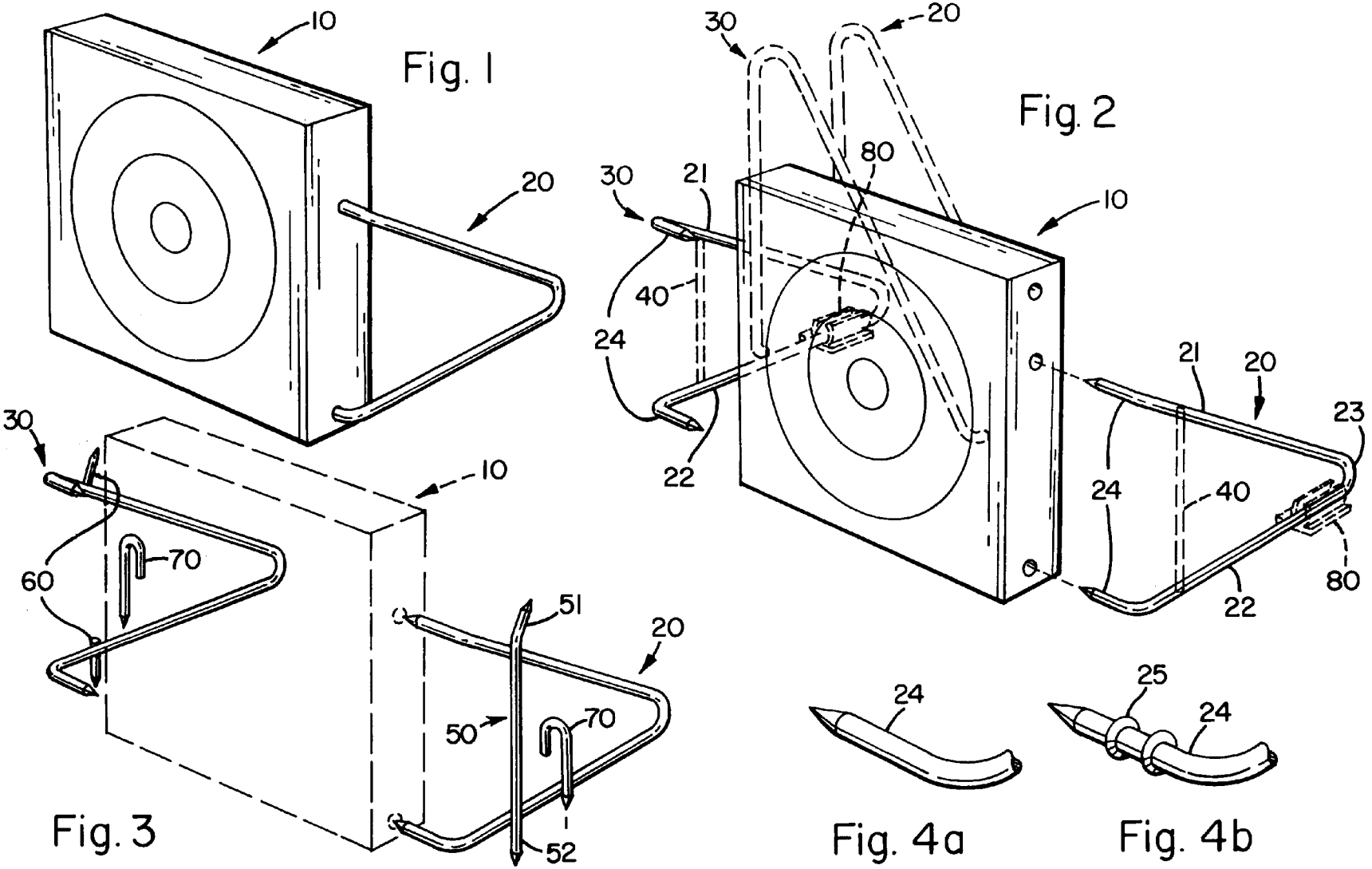
FIG. 1 shows an isometric view of the preferred embodiment of the target support system in combination with a typical archery target.
FIG. 2 shows an exploded isometric view of the support system in combination with a typical archery target depicting the major elements of each support, optional support braces, optional protective bumpers and also shows a method for transporting the target.
FIG. 3 shows additional embodiments of the target supports with elements to provide ground anchoring.
FIGS. 4A and 4B show details of two embodiments of the insertion fingers which are used to connect the supports to the target.

| Reference Numerals in Drawing | |
|---|---|
| 10 | typical archery target |
| 20 | right support |
| 21 | upper member |
| 22 | base member |
| 23 | radiused intersection |

-continued

| Reference Numerals in Drawing | |
|---|---|
| 24 | insertion finger |
| 25 | friction ring |
| 30 | left support |
| 40 | strengthening brace |
| 50 | strengthening brace with ground anchors |
| 51 | ground anchor (for upper member) |
| 52 | ground anchor (for base member) |
| 60 | integral ground anchor |
| 70 | separate ground anchor |
| 80 | protective bumper |

SUMMARY

According to the present invention a target support system comprising a right and left support, having insertion fingers which attach to the target and which provide means for changing the target presentation angle.

DESCRIPTION—FIGS. 1 to 4B

A typical embodiment of the target stabilizing support system of the present invention is illustrated in FIG. 1 (isometric view) and FIG. 2 (exploded isometric view), with FIG. 2 showing additional embodiments which may be included. The system is composed of a right support 20 and a left support 30 as shown in FIG. 2. The left support 20 mirrors the right support 30 as they are symmetrical about the vertical center axis of the face of the target 10. Each support 20 and 30 is of uniform cross section made from a material strong enough to provide target 10 support and resist arrow impact. In the preferred embodiment, both the right support 20 and left support 30 are made from steel rod stock with a painted surface treatment. The supports 20 and 30 can, however, be made from aluminum, plastic, iron, square or round tubing or any other material that meets the desired strength and impact requirements. Surface treatments can include any that provide adequate corrosion resistance for outdoor products such as galvanization, painting, anodizing, electrochemical deposition, etc.

The right support 20 and left support 30 each include an upper member 21 and a base member 22 as shown in FIG. 2. The upper member 21 and base member 22 are sized such that the target 10 is generally perpendicular to the base member 22 (viewed from the side) when both insertion fingers 24 of a given support 20 or 30 are inserted into the side of the target 10 at its centerline. A radiused intersection 23 joins the upper member 21 and base member 22 of both the right support 20 and the left support 30 at the angle determined by the length of the upper member 21, the length of the base member 22 and the preceding description. The upper member 21 is roughly 25 inches in length, with the base member 22 being roughly 20 inches in length. The material used to form the left support 20 and right support 30 is typically from 0.250 inch to 0.500 inch in diameter.

FIG. 2 also depicts the addition of a strengthening brace 40 to both the right support 20 and the left support 30. The strengthening brace 40 is typically of the same material as the right support 20 and left support 30, and is typically attached to the base member 22 at a distance of 0.5 inch to 3 inches from the associated insertion finger 24. The strengthening brace 40 is typically perpendicular to the base member 22 and attaches to the upper member 21 at the intersection of the strengthening brace 40 and the upper member 21. The length of the strengthening brace 40 is equal to the distance between attachment points with a minimal addition of length to meet any processing needs. The attachment method is typically performed by welding at the intersection points, but may be performed by use of fasteners, adhesives, frictional geometries or any other appropriate joining method.

An insertion finger 24 proceeds from the target end of each of the upper member 21 and of the base member 22 of each support 20 and 30, with the longitudinal axis of each insertion finger 24 falling into a plane which is typically perpendicular (or at an interior angle greater than 90 degrees) to the plane defined by the longitudinal axes of both the upper member 21 and the base member 22 of the support 20 or 30 from which the insertion finger 24 proceeds. Each insertion finger 24 is generally angled toward the target 10 which it will support as shown in FIG. 2.

FIG. 2 also shows the addition of a protective bumper 80 to the right support 20 and left support 30. The protective bumper 80 is typically made of a polymeric or other soft and durable material such as rubber. The protective bumper 80 is located generally near the radiused intersection 23 of each support 20 and 30 on either the upper member 21 or the base member 22, depending upon which target orientation is employed. The protective bumper 80 is removable for use in multiple locations as desired.

FIG. 4A shows the typical embodiment of the insertion point 24. The insertion finger 24 is typically 2 inches to 4 inches in length. Each insertion finger 24 has a typically conical point as seen in FIG. 4A. FIG. 4B shows an additional embodiment of the insertion finger 24 which includes a series of friction rings 25. Each friction ring 25 is typically an annular projection from the surface of each insertion finger. Each friction ring 25 is typically 0.060 inch wide by 0.060 inch high.

Additional embodiments depicting a variety of ground anchors are shown in FIG. 3. FIG. 3 shows the addition of a strengthening brace with ground anchors 50 which is of the same material and location as the strengthening brace 40 of FIG. 2. The strengthening brace with ground anchors 50 of FIG. 4B differs from the strengthening brace 40 by the addition of approximately 3 inches to 5 inches of length beyond each attachment point to form a ground anchor (for upper member) 51 and a ground anchor (for base member) 52. For each support 20 and 30, the ground anchor (for upper member) 51 is perpendicular to the upper member 21 (when viewed from the side) and falls within a plane parallel to the plane defined by the upper member 21 and base member 22. Likewise, for each support 20 and 30, the ground anchor (for base member) 52 is perpendicular to the base member 22 (when viewed from the side) and falls within a plane parallel to the plane formed by the upper member 21 and base member 22 of each support. The end of each ground anchor 51 and 52 is typically conical, forming a point.

FIG. 3 also shows the addition of integral ground anchors 60 to each upper member 21 and base member 22. Each integral ground anchor 60 is attached by welds, fasteners, adhesives or any other suitable joining method. Each integral ground anchor 60 is placed approximately 1 inch to 3 inches from each insertion finger 24 along the axis of the base member 21 or the upper member 22 as applicable, resulting in typically 2 integral ground anchors per support 20 and 30. For each upper member 21, the integral ground anchor 60 is perpendicular to the upper member 21 (when viewed from the side) and falls within a plane parallel to the plane defined by the upper member 21 and base member 22 of each support 20 and 30. Likewise, for each base member 22, the integral ground anchor 60 is perpendicular to the base member 22 (when viewed from the side) and falls within a plane parallel to the plane formed by the upper member 21 and base member 22 of each support 20 and 30. The end of each integral ground anchor 60 is typically conical, forming a point, and each integral ground anchor is oriented so that the point is directed away from the interior of the angle of the support 20 or 30.

FIG. 3 additionally discloses separate ground anchors 70 which consist of a typically 3 inches to 5 inches long pin of circular cross section with a straight portion and a semi-circular bend on one end. The straight section has a typically conical end. For the upright position, the separate ground anchors 70 are typically placed 1 inch to 3 inches from the insertion fingers 24 of the base member 22 of each support 20 or 30, with the semi-circular section contacting the base member 22 and the straight section pressed into the ground, perpendicular with the surface of the ground. For the inclined position, the separate ground anchors 70 are placed on the upper members 21 in like position.

OPERATION—FIGS. 2,3, 5A–7B

The manner of using the preferred embodiment of the target support system disclosed herein is shown in FIG. 1 and FIG. 2. With the target 10 in the normal upright position, the right side (viewed from the front) of the target 10 is presented and secured by rotating the target 90 degrees (about an axis perpendicular to the front and back of the target 10 and passing through its center) counterclockwise when viewed from the front so that the left side of the target 10 is on the ground and the right side is up and exposed for support insertion. The insertion finger 24 of the base member 22 of the right support 20 is placed on approximately the vertical centerline of the right side of the target at a location approximately 0.5 inch from the bottom edge of the target; the insertion finger 24 of the upper member 21 of the same support 20 is placed at the point it contacts the vertical centerline of the right side of the target 10 (will be more toward the top of the target 10 than the finger 24 of the base member 22). Both insertion fingers 24 are then pushed into the right side of the target 10 until the upper member 21 and base member 22 are seated against the right side of the target 10. Upon completion of the insertion, a plane passing through the upper member 21 and base member 22 should be generally perpendicular to the front and rear of the target 10.

Figure 5A:
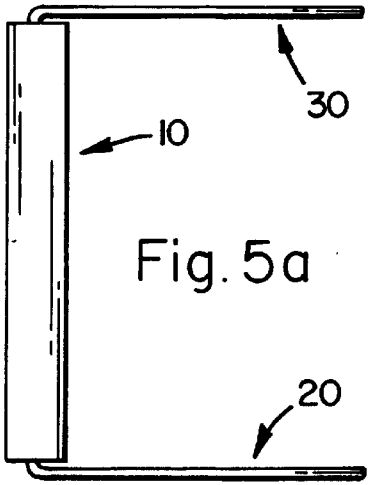
FIGS. 5A and 5B show a top view and a side view respectively of the vertical position of the combined target and support system.
Figure 5B:
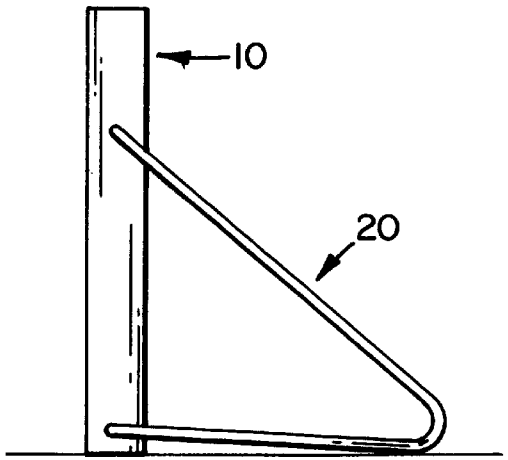

Upon insertion of the right support 20, the target 10 is rotated 180 degrees (about an axis perpendicular to the front and back of the target 10 and passing through its center) until the right side of the target 10 is on the ground and the left side is up and exposed for support insertion. The left support 30 is now inserted in the same manner as described for the right support 20. Once assembled, the target 10 becomes a structural member working in conjuction with the supports 20 and 30 to rigidly hold the target 10. With both the right support 20 and left support 30 attached, the target 10 is placed back in upright position with both base members 22 parallel to and in contact with the ground. This upright position is shown in FIG. 5A and FIG. 5B. The target 10 with assembled right support 20 and left support 30 in the described position is then used to stop and mark the accuracy of arrows or other projectiles as desired.

Figure 6A:
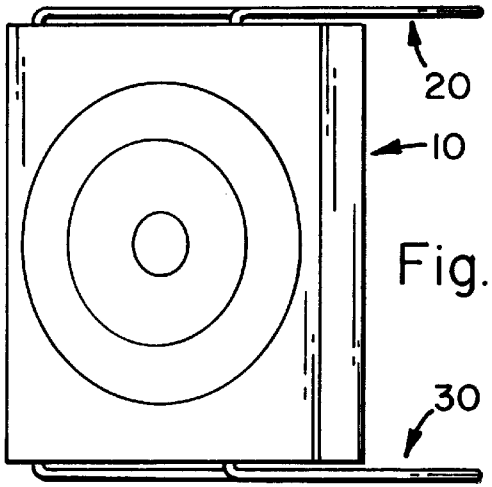
FIGS. 6A and 6B show a top view and a side view respectively of an inclined position of the combined target and support system achieved by interchanging the supports.
Figure 6B:
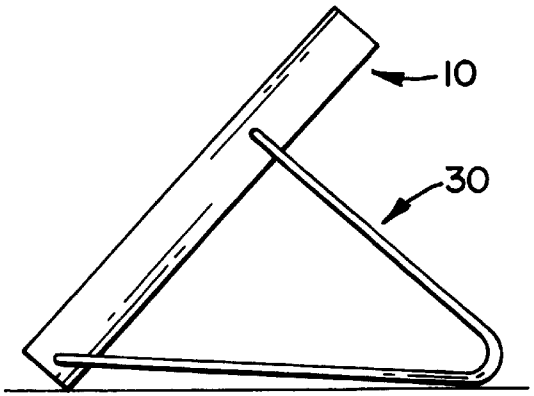

The target 10 may be presented in an inclined position by reversing the side each support is inserted into. This is shown in FIG. 6A and FIG. 6B. The left support 30 is inserted into the right side of the target 10 with the insertion finger 24 of the upper member 21 located approximately 0.5 inch from the bottom of the target 10 on the vertical centerline of the right side of the target 10. The insertion finger 24 of the base member 22 is located on the vertical centerline of the target 10 (more toward the top of the target 10 than the finger 24 of the upper member 21). The left support 30 is inserted into the right side of the target 10 in the same manner as for the upright position. The base member 22 will be generally perpendicular to the front and rear faces of the target 10. The right support 20 is now inserted into the left side of the target 10 in like manner as for the left support 30 just described. With each upper member 21 placed parallel to and in contact with the ground (or floor if appropriate), the target 10 is in the inclined position of FIGS. 6A and 6B.

Figure 7A:
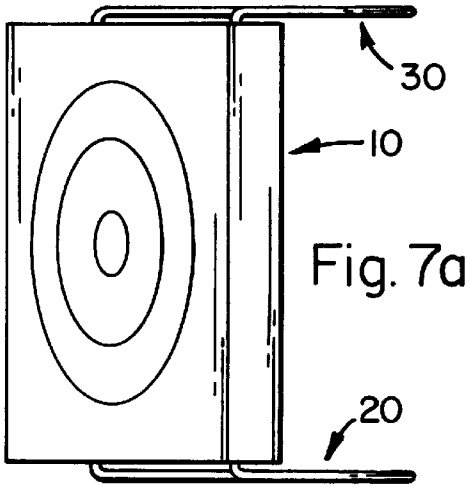
FIGS. 7A and 7B show a top view and a side view respectively of an inclined position of the combined target and support system achieved by moving the vertical attachment position of the supports.
Figure 7B:
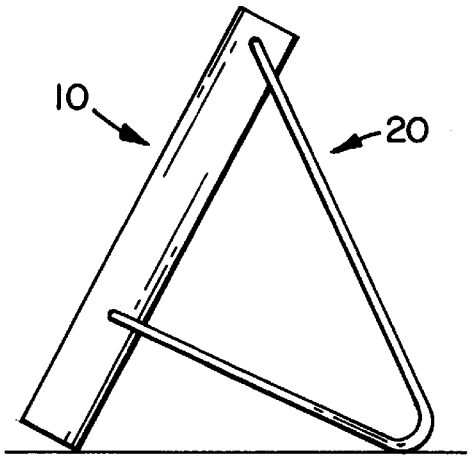

The orientation angle of the target may also be changed by simply moving the support attachment points vertically upward along the centerline of the side of the target 10 as shown in FIG. 7A and FIG. 7B. The target is then allowed to rotate with the gravitational force on the supports until the supports rest upon the underlying surface. This procedure allows a multitude of angles to be chosen, and can be employed with the supports 20 and 30 on either side. Reversing the target 10 attachment sides of the supports 20 and 30 only serves to increase the range of angles which may be selected.

For the alternative embodiment including a strengthening brace 40 shown in FIG. 2, the right support 20 and left support 30 are assembled exactly as previously described for the preferred embodiment; this applies to both the upright (FIG. 5B) and inclined (FIG. 6B and FIG. 7B) target 10 positions. The difference in operation is the added rigidity to the right support 20 and left support 30 due to the strengthening brace 40. This makes for stronger and more durable supports, particularly during unassembled transportation when the target 10 cannot function as a structural member. Both the preferred embodiment and the alternative embodiment of FIG. 2 can be used either indoors or outdoors as already described.

FIG. 3 shows embodiments with additional elements to be used for anchoring the target 10 and supports 20 and 30 to the ground if desired. FIG. 3 shows the addition of a strengthening brace with ground anchors 50 each of which includes a ground anchor (for upper member) 51 and a ground anchor (for base member) 52. The ground anchors 51 or 52 are simply pushed into the ground after the target 10 and supports 20 and 30 are assembled as described for the preferred embodiment of FIG. 2. This embodiment including the strengthening brace with ground anchors 50 also provides the benefits of the strengthening brace 40 as described previously. Additionally, FIG. 3 shows an embodiment with integral ground anchors 60 on both the upper member 21 and base member 22. These integral ground anchors 60 are also simply pushed into the ground upon completion of assembly of the target 10 and supports 20 and 30. For embodiments using the strengthening brace with ground anchors 50 or integral ground anchors 60, only half of the ground anchors 60, 51 or 52 will be pushed into the ground at any one time as determined by which target 10 position is chosen. If the upright position of FIG. 5B is chosen, then the base member 22 rests upon the ground and the anchors 52 or 60 attached to it are pushed into the ground by applying force downward on the target 10 and supports 20 and 30 assembly. If the inclined position of FIG. 6B is chosen, then the upper member 21 rests upon the ground and the anchors 51 or 60 attached to it are pushed into the ground in like manner.

Separate ground anchors 70 are also shown in FIG. 3. These anchors 70 secure the target 10 to the ground when the straight section of the anchor 70 is pushed perpendicularly into the ground such that the semi-circular section entraps either the upper member 21 or base member 22, whichever is resting upon the ground. The separate ground anchors are positioned approximately 1 inch behind the target 10.

Protective bumpers 80 are shown in FIG. 2. These protective bumpers 80 are used to prevent damage to surfaces such as gymnasium floors by separating the supports 20 and 30 from such a surface with a soft material. If a material with a relatively higher coefficient of friction is used for its manufacture, the protective bumper 80 also serves as an anti-skid device to help prevent the target from sliding on hard surfaces. The protective bumper 80 is typically removable so that it may be placed on the upper member 21 or base member 22 as appropriate to protect the underlying surface.

During operation, only the insertion fingers 24 fall within the actual arrow impact area defined by the projected area normal to the faces of the target 10, thereby minimizing potential arrow damage.

The target 10, right support 20 and left support 30 are easily disassembled. If ground anchors are used, the target 10 is gripped and pulled in a direction perpendicular to the ground until the anchors are free. The right support 20 is then pulled perpendicularly away from its side of the target 10 until the insertion fingers 24 are free. The left support 30 is then pulled perpendicularly away from its side of the target 10 until the insertion fingers 24 are free. The supports 20 and 30 may now be moved separately, or inserted into the front and/or rear faces of the target 10 for compact storage. The phantom line supports 20 and 30 of FIG. 2 shows such an arrangement where the right support 20 and left support 30 are used to form carrying handles for the target 10.

SUMMARY, RAMIFICATIONS AND SCOPE

Accordingly, the reader will see that the stabilizing support system of this invention can be used to rigidly hold and present an archery target to a user in an optimum manner to maximize archery practice time. The use of this support system in conjunction with common polyethylene foam archery targets is easily, quickly, reliably and inexpensively accomplished. Upon completion of the target practice session, the stabilizing support system can be quickly and easily disassembled and even used as carrying handles for the target. They add very little storage space to that required by the target itself, and are sufficiently large as not to be easily lost. Furthermore the stabilizing support system has the additional advantages in that:

- it can support similar devices not restricted to polyethylene archery targets;
- it can present the target at any of a multiplicity of angles for both ground level and elevated shooting simulation;
- it will hold an archery target stable over an extended period of shooting activity;
- it will minimize potential damage to arrows;
- it is safe to use;
- it is readily transportable;
- it is compact in size;
- it can be used both indoors and outdoors on a variety of surfaces;
- it can function for many years without need for replacement or service;
- it needs no adjustment during extended use;
- it does not damage the target it supports.
- it will accommodate a wide range of target sizes of many different materials;

Although the preceding description contains many specificities, these should not be construed as limiting the scope of the invention but as merely providing illustrative examples of some of the preferred embodiments of this invention.

The typical dimensions need not be restrictive as any dimensions and/or geometries that meet the functional intent of the device may be used. Similarly, the pointed section of the insertion fingers and ground anchors may be of any geometry (including flattened, sheared, etc.) which accommodates the function of said fingers and need not be strictly conical. A given support system need not have an upright position, as angled positions only might be desired. It is foreseeable that hinges or relative motion features could be added at strategic points such as the radiused intersection or insertion fingers for more compact storage. Insertion fingers could attach to the top or bottom or through the rear face of the target. The support system need not use insertion fingers at all and might include any device which could attach the support to the target. Other shapes of the support elements, bracing, ground anchors and friction elements could be devised, as well as incorporation of additional numbers of these elements.

The preferred method of operation of the stabilizing support system should serve merely to show the utility of the function. Many combinations and variations of the steps described to operate this device are possible, and the operations listed are not intended to restrict them. Furthermore, there are methods and functions not described to which this invention will apply such as support for devices not in the archery field, support for devices not rectangular, etc.

Thus, the scope of the invention should be determined by the appended claims and their legal equivalents, rather than by the examples given.

I claim:

1. A support system for stabilizing a conventional foam archery target and presenting said target in a multiplicity of possible orientations with said support system including:

a right support for said target;

and a left support for said target;

with each of said supports including:

a base member;

an upper member;

means for joining said base member to said upper member;

and means for joining said supports to said target;

with said base members, said upper members and said means for joining said base members to said upper members located outside the perimeter of said target;

whereby said target is solidly held in a desired position and whereby arrows impacting said target have a minimal probability of impacting said supports.

2. The support system for stabilizing a conventional foam archery target of claim 1 wherein said means for joining said support to said target includes elongated insertion fingers with tapered ends whereby said insertion fingers penetrate and frictionally interact with said target.

3. The support system for stabilizing a conventional foam archery target of claim 2 wherein said insertion finger includes friction elements comprising one or more surface irregularities on said insertion finger whereby friction between said target and said insertion finger is increased.

4. The support system for stabilizing a conventional foam archery target of claim 3 wherein said surface irregularity includes an annular ring projecting from the surface of said insertion finger.

5. The support system for stabilizing a conventional foam archery target of claim 1 wherein said right support and said left support each further includes a strengthening brace connecting the otherwise unconnected ends of said upper member to said base member whereby each support is strengthened for increased durability.

6. The support system for stabilizing a conventional foam archery target of claim 5 wherein said right support and said left support are each made from an elongated base material with said supports having means for preventing corrosion of said supports.

7. The support system for stabilizing a conventional foam archery target of claim 1 wherein said supports further include ground anchors comprising projections from said supports whereby said supports may be joined to the surface upon which said supports rest.

8. The support system for stabilizing a conventional foam archery target of claim 1 wherein said supports further include ground anchors comprising separate parts which connect both said right support and said left support with the surface upon which said supports rest.

9. The support system for stabilizing a conventional foam archery target of claim 1 wherein said support system further includes means for changing the orientation angle of said target.

10. The support system for stabilizing a conventional foam archery target of claim 9 wherein said means for changing the orientation angle includes:

a predetermined length of said upper member;

a predetermined length of said base member, with said length of said base member being unequal to said length of said upper member;

and a predetermined angle between said upper member and said base member, such that said target is presented at a different angle if both said right support and said left support are interchanged;

whereby said target may be presented in a generally upright position when said base members are located along the surface upon which said target rests; and whereby said target may be presented in a generally inclined position when said upper members are located along said surface.

11. The support system for stabilizing a conventional foam archery target of claim 1 wherein said supports include means for assembling said supports to said target in such a way as to form a carrying handle whereby target may be readily transported.

12. The support system for stabilizing a conventional foam archery target of claim 1 wherein said supports include means for protecting underlying surfaces from damage by said supports.

13. The support system for stabilizing a conventional foam archery target of claim 12 wherein said means for protecting underlying surfaces includes typically polymeric protective bumpers which are attached to said supports, whereby said protective bumpers serve as a barrier between said supports and said surface.

14. The support system for stabilizing a conventional foam archery target of claim 1 wherein said right support and said left support are each made from a single piece of elongated material.

15. The support system for stabilizing a conventional foam archery target of claim 14 wherein said elongated material is steel.

16. The support system for stabilizing a conventional foam archery target of claim 14 wherein said supports include means for preventing corrosion of said supports.

17. The support system for stabilizing a conventional foam archery target of claim 1 wherein said support system integrally uses said archery target as structural member without requiring that said supports be joined to the surface upon which said supports rest.

18. A support system for stabilizing an object and presenting said object in a multiplicity of possible orientations with said support system including:

a right support for said object;

and a left support for said object;

means for changing the orientation of said object;

with each of said supports including:

a base member;

an upper member;

means for joining said base member to said upper member;

and means for joining said supports to said object;

with each of said supports being made from a single piece of elongated material;

and with said means for changing the orientation of said object including:

a predetermined length of said upper member;

a predetermined length of said base member, with said length of said base member being unequal to said length of said upper member;

and a predetermined angle between said upper member and said base member, such that said object is presented at a different angle if both said right support and said left support are interchanged;

whereby, said object is rigidly held and may be presented in a multiplicity of possible angles.

19. A method for varying the presentation angle of a conventional foam archery target which is held by stabilizing supports and which is resting upon a surface with said method including:

varying the relative location of the connection points of said supports to said target with respect to the bottom of said target;

and allowing said target to rotate about its line of contact with said surface until said supports contact the surface;

whereby various presentation angles are formed as said supports come to rest upon said surface.

* * * * *